US007192247B2

(12) United States Patent
Suga et al.

(10) Patent No.: US 7,192,247 B2
(45) Date of Patent: Mar. 20, 2007

(54) STEAM TURBINE POWER GENERATION SYSTEM AND LOW-PRESSURE TURBINE ROTOR

(75) Inventors: Takeo Suga, Yokohama (JP); Ryuichi Ishii, Edogawa-ku (JP); Takeo Takahashi, Yokohama (JP); Masafumi Fukuda, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/282,851

(22) Filed: Nov. 21, 2005

(65) Prior Publication Data

US 2006/0127216 A1 Jun. 15, 2006

(30) Foreign Application Priority Data

Dec. 14, 2004 (JP) ..... 2004-361304

(51) Int. Cl.
*F01D 5/14* (2006.01)
*F01D 1/02* (2006.01)

(52) U.S. Cl. ..... 415/200; 415/199.5; 415/216.1

(58) Field of Classification Search ..... 415/200, 415/198.1, 199.5, 216.1
See application file for complete search history.

(56) References Cited

U.S. PATENT DOCUMENTS 6,129,514 A * 10/2000 Shiga et al. ..... 415/200
6,358,004 B1 * 3/2002 Shiga et al. ..... 415/200
6,575,700 B2 * 6/2003 Arai et al. ..... 415/200

FOREIGN PATENT DOCUMENTS

| | | |
|---|---|---|
| JP | 9-195701 | 7/1997 |
| JP | 9-287402 | 11/1997 |
| JP | 2000-328904 | 11/2000 |
| JP | 2003-27192 | 1/2003 |
| JP | 2004-36469 | 2/2004 |
| JP | 2004-36527 | 2/2004 |

OTHER PUBLICATIONS

U.S. Appl. No. 11/375,463, filed Mar. 15, 2006, Suga et al.
U.S. Appl. No. 11/282,851, filed Nov. 21, 2005, Suga et al.

* cited by examiner

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

A steam turbine power generation system, comprising a high-pressure turbine, an intermediate-pressure turbine and a low-pressure turbine, wherein the intermediate-pressure turbine has an inlet steam temperature of 650–720° C., and the low-pressure turbine has an inlet steam temperature of 410–430° C.; and a low-pressure turbine rotor of the low-pressure turbine is made of a heat-resisting steel which contains, in weight percent, C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0, and the balance of Fe, unavoidable impurities and unavoidable gases, and the unavoidable impurities contain, in weight percent, P: 0.004 or less, S: 0.002 or less, Sn: 0.01 or less, As: 0.008 or less, Sb: 0.005 or less, Al: 0.008 or less and Cu: 0.1 or less.

7 Claims, 3 Drawing Sheets

STEAM TURBINE POWER GENERATION SYSTEM AND LOW-PRESSURE TURBINE ROTOR

CROSS-REFERENCE TO RELATED APPLICATIONS

This application is based upon and claims the benefit of priority from the prior Japanese Patent Application No. 2004-361304 filed on Dec. 14, 2004; the entire contents of which are incorporated herein by reference.

BACKGROUND

1. Field of the Invention

The present invention relates to a steam turbine power generation system, which is provided with a steam turbine having a temperature of a driving steam raised to a high temperature, and a low-pressure turbine rotor.

2. Description of the Related Art

It is general that a steam turbine power generation system is provided with a high-pressure turbine, an intermediate-pressure turbine and a low-pressure turbine. A high-temperature, high-pressure driving steam supplied from a boiler flows into the high-pressure turbine, rotates the high-pressure turbine in high-pressure blade stages to perform expansion work and then is discharged out of the high-pressure turbine. The driving steam discharged from the high-pressure turbine is supplied sequentially to the intermediate-pressure turbine and the low-pressure turbine to rotate the individual turbines to perform expansion work, and discharged to a condenser for condensation to water.

In recent years, steam turbine power generation systems having a higher inlet steam temperature of the high-pressure turbine in order to improve a thermal efficiency are increasing, and they have a tendency that driving steam has a large difference in temperature between the inlet and the outlet of the steam turbine. To deal with the temperature difference, there are disclosed conventional steam turbine power generation systems which are provided with a steam turbine having, for example, a high-temperature material as a rotor material (e.g., Japanese Patent Laid-Open Applications No. Hei 09-287402, No. Hei 09-195701, No. 2003-27192 and No. 2004-36469) and a steam turbine having a cooling structure for the steam inlet portion of the steam turbine (e.g., Japanese Patent Laid-Open Applications No. 2000-328904 and No. 2004-36527).

As described above, the conventional steam turbine power generation systems have the steam temperature at the low-pressure turbine inlet set to a temperature at which mechanical strength of, for example, a material for the low-pressure turbine rotor can be maintained. It is mainly because considerable embrittlement due to aging or sometimes simultaneous embrittlement and softening are caused if the material for the conventional low-pressure turbine rotor has a temperature exceeding the temperature at which the mechanical strength can be maintained.

Therefore, where the driving steam temperature at the steam turbine inlet was raised to a high level, it was necessary to increase the expansion work load by the high-pressure turbine and the intermediate-pressure turbine to lower the driving steam temperature at the low-pressure turbine inlet to a temperature at which embrittlement of the low-pressure turbine rotor material due to aging or softening due to aging could be suppressed.

As a result, there was a disadvantage that the number of blade stages of the high-pressure turbine and the intermediate-pressure turbine was increased, resulting in increasing the whole turbine size. And, the increase in number of stages of the high-pressure turbine and the intermediate-pressure turbine increased the distance between bearings supporting the high-pressure turbine and the intermediate-pressure turbine, becoming a major cause of the vibration of the turbine.

BRIEF SUMMARY OF THE INVENTION

According to an embodiment of the present invention, there is provided a steam turbine power generation system and a low-pressure turbine rotor that even when a high-pressure turbine and an intermediate-pressure turbine have a high inlet steam temperature, a low-pressure turbine can be operated without increasing the number of stages of the high-pressure turbine and the intermediate-pressure turbine.

According to an aspect of the present invention, there is provided a steam turbine power generation system, comprising a high-pressure turbine, an intermediate-pressure turbine and a low-pressure turbine, wherein the intermediate-pressure turbine has an inlet steam temperature of 650 to 720° C. and the low-pressure turbine has an inlet steam temperature of 410 to 430° C.; and a low-pressure turbine rotor of the low-pressure turbine is made of a heat-resisting steel which contains, in weight percent, C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0, and the balance of Fe, unavoidable impurities and unavoidable gases, and the unavoidable impurities contain, in weight percent, P: 0.004 or less, S: 0.002 or less, Sn: 0.01 or less, As: 0.008 or less, Sb: 0.005 or less, Al: 0.008 or less and Cu: 0.1 or less.

According to another aspect of the present invention there is provided a steam turbine power generation system, comprising a high-pressure turbine, an intermediate-pressure turbine and a low-pressure turbine, wherein the intermediate-pressure turbine has an inlet steam temperature of 650 to 720° C., and the low-pressure turbine has an inlet steam temperature of 410 to 430° C.; and a low-pressure turbine rotor of the low-pressure turbine is made of a heat-resisting steel which contains, in weight percent, C: 0.24 to 0.27, Si: 0.03 or less, Mn: 0.03 or less, Cr: 1.6 to 1.8, V: 0.1 to 0.15, Mo: 0.4 to 0.45, Ni: 3.5 to 4.0, and the balance of Fe, unavoidable impurities and unavoidable gases, and the unavoidable impurities contain, in weight percent, P: 0.003 or less, S: 0.0015 or less, Sn: 0.005 or less, As: 0.006 or less, Sb: 0.0015 or less, Al: 0.005 or less and Cu: 0.05 or less.

According to the above steam turbine power generation systems, even when the intermediate-pressure turbine has a high inlet steam temperature of 650 to 720° C., the number of stages of the high-pressure turbine and the intermediate-pressure turbine can be suppressed from increasing, and the low-pressure turbine can be operated because the low-pressure turbine is provided with the low-pressure turbine rotor which is made of the heat-resisting steel having the above-described chemical compositions.

According to still another aspect of the present invention, there is provided a low-pressure turbine rotor of a low-pressure turbine in a steam turbine power generation system which is comprised of a high-pressure turbine, an intermediate-pressure turbine and the low-pressure turbine, the intermediate-pressure turbine having an inlet steam temperature of 650 to 720° C., and the low-pressure turbine having an inlet steam temperature of 410 to 430° C., wherein the low-pressure turbine rotor is made of a heat-resisting steel which contains, in weight percent, C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0, and the balance of Fe, unavoidable impurities and unavoidable gases, and the unavoidable impurities contain, in weight percent, P: 0.004 or less, S: 0.002 or less, Sn: 0.01 or less, As: 0.008 or less, Sb: 0.005 or less, Al: 0.008 or less and Cu: 0.1 or less.

According to another aspect of the present invention, there is provided a low-pressure turbine rotor of a low-pressure turbine in a steam turbine power generation system which is comprised of a high-pressure turbine, an intermediate-pressure turbine and the low-pressure turbine, the intermediate-pressure turbine having an inlet steam temperature of 650 to 720° C., and the low-pressure turbine having an inlet steam temperature of 410 to 430° C., wherein the low-pressure turbine rotor is made of a heat-resisting steel which contains, in weight percent, C: 0.24–0.27, Si: 0.03 or less, Mn: 0.03 or less, Cr: 1.6–1.8, V: 0.1–0.15, Mo: 0.4–0.45, Ni: 3.5–4.0, and the balance of Fe, unavoidable impurities and unavoidable gases, and the unavoidable impurities contain, in weight percent, P: 0.003 or less, S: 0.0015 or less, Sn: 0.005 or less, As: 0.006 or less, Sb: 0.0015 or less, Al: 0.005 or less and Cu: 0.05 or less.

According to the above-described low-pressure turbine rotors, even when the intermediate-pressure turbine has a high inlet steam temperature of 650 to 720° C., the number of stages of the high-pressure turbine and the intermediate-pressure turbine can be suppressed from increasing and the low-pressure turbine can be operated because the low-pressure turbine rotor has the above-described chemical compositions.

BRIEF DESCRIPTION OF THE DRAWINGS

The present invention is described with reference to the drawings, which are provided for illustration only and do not limit the present invention in any respect.

DETAILED DESCRIPTION OF THE INVENTION

Figure 1:
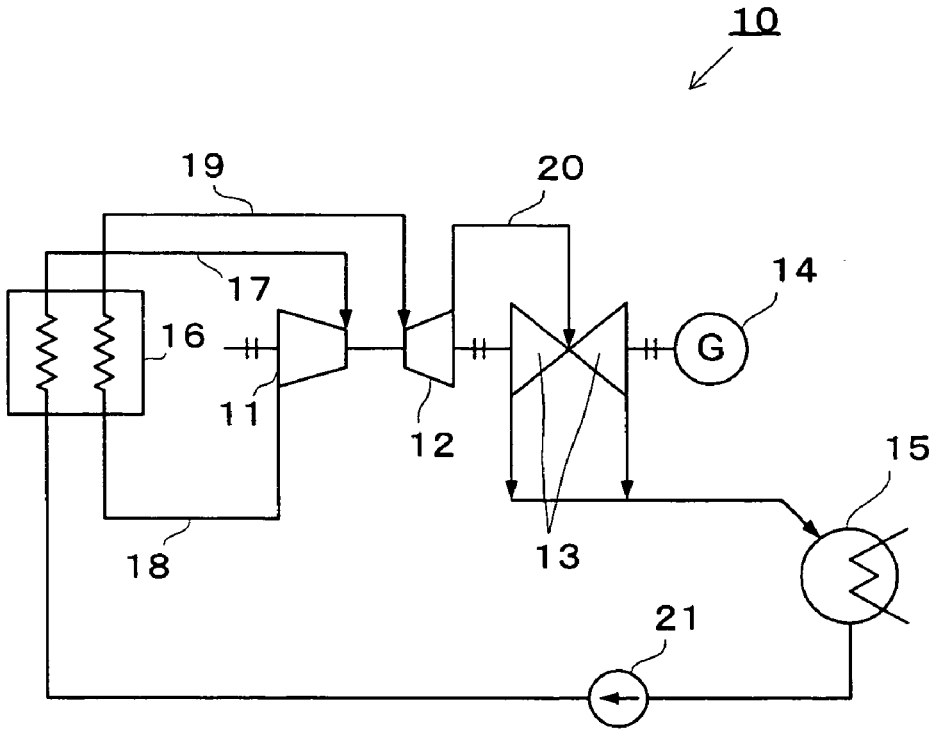
FIG. 1 is a diagram showing an overview of a structure of the steam turbine power generation system according to a first embodiment of the present invention.

Embodiments of the present invention will be described with reference to the drawings.

(First Embodiment)

In a steam turbine power generation system provided with a high-pressure turbine, an intermediate-pressure turbine and a low-pressure turbine, wherein an inlet steam temperature of the intermediate-pressure turbine is 650 to 720° C., and an inlet steam temperature of the low-pressure turbine is 410 to 430° C., a heat-resisting steel configuring a low-pressure turbine rotor of the low-pressure turbine is appropriately selected from a heat-resisting alloy (M1) or (M2) having the following chemical composition range depending on conditions. Here, the inlet steam temperature of the high-pressure turbine may be set to 650 to 720° C. The ratio of chemical compositions shown below is expressed in percent by weight unless otherwise specified.

(M1) Heat resisting steel which contains C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0 and the balance of Fe, unavoidable impurities and unavoidable gases, and the unavoidable impurities contain, in percent by weight, P: 0.004 or less, S: 0.002 or less, Sn: 0.01 or less, As: 0.008 or less, Sb: 0.005 or less, Al: 0.008 or less and Cu: 0.1 or less.

(M2) Heat resisting steel which contains C: 0.24 to 0.27, Si: 0.03 or less, Mn: 0.03 or less, Cr: 1.6 to 1.8, V: 0.1 to 0.15, Mo: 0.4 to 0.45, Ni: 3.5 to 4.0 and the balance of Fe, unavoidable impurities and unavoidable gases, and the unavoidable impurities contain, in percent by weight, P: 0.003 or less, S: 0.0015 or less, Sn: 0.005 or less, As: 0.006 or less, Sb: 0.0015 or less, Al: 0.005 or less and Cu: 0.05 or less.

Then, the reasons of limiting the individual components of the heat-resisting steel of the present invention to the above-described ranges will be described.

(1) C (Carbon)

C is an element indispensable as a component element of various types of carbides which contribute to securing of quenchability from a steel ingot surface layer section toward the center and enhancement of precipitation in a large steel ingot such as a low-pressure turbine rotor material. The heat-resisting steel according to the present invention does not provide the above effects sufficiently if the content of C is less than 0.24%, but has a high tendency of segregation when the steel ingot coagulates if the C content exceeds 0.28%. For these reasons, the C content is determined to be 0.24 to 0.28%. And, the C content is more preferably 0.24 to 0.27%.

(2) Si (Silicon)

Si is useful as a deoxidizing agent and improves the resistance to water vapor oxidation, and its effect is developed by adding it in at least 0.005% or more. But, if its content is excessive, the ductility is reduced, and embrittlement due to aging is accelerated. Therefore, it is desirable that the Si content is reduced as much as possible. And, the heat-resisting steel according to the present invention suffers from a considerable decrease in the above-described effects if the Si content exceeds 0.03%. For these reasons, the Si content is determined to be 0.005 to 0.03%.

(3) Mn (Manganese)

Mn is an element useful as a desulfurizing agent and develops its effect when added in at least 0.005% or more. But, if its content increases, the produced amount of sulfides increases, and creep strength lowers. The increase of the sulfides and the decrease of the creep strength develop if the Mn content exceeds 0.05%. For these reasons, the Mn content is determined to be 0.005 to 0.05%. And, the Mn content is more preferably 0.005 to 0.03%.

(4) Cr (Chrome)

Cr is an element indispensable as a component element of carbonitride which is effective to provide resistance to oxidation and corrosion and contributes to enhancement of precipitation. If the Cr content is less than 1.5%, a moved amount of Cr to the carbonitride cannot be secured after a tempering heat treatment, and if the Cr content exceeds 2.0%, the resistance to temper softening lowers, desired room temperature strength cannot be secured, and creep strength also lowers. For these reasons, the Cr content is determined to be 1.5 to 2.0%. And, the Cr content is more preferably 1.6 to 1.8%.

(5) V (Vanadium)

V contributes to the reinforcement of a solid solution and formation of fine carbonitrides. If the V content is 0.07% or more, fine precipitates are formed sufficiently to suppress recovery of a mother phase, but if it exceeds 0.15%, toughness is reduced. For these reasons, the V content is determined to be 0.07 to 0.15%. And, the V content is more preferably 0.1 to 0.15%.

(6) Mo (Molybdenum)

Mo contributes to the reinforcement of a solid solution and becomes a component element of carbonitride to contribute to the reinforcement of precipitation. It also contributes to the improvement of quenchability. If the Mo content is 0.25% or more, the heat-resisting steel according to the present invention develops the above-described effects, but if the Mo content exceeds 0.5%, ductility is reduced, and the tendency of segregation of the components of a large steel ingot increases. For these reasons, the Mo content is determined to be 0.25 to 0.5%. And, the Mo content is more preferably 0.4 to 0.45%.

(7) Ni (Nickel)

Ni has an effect to improve quenchability and ductility, and the heat-resisting steel according to the present invention develops its effect when the Ni content is 3.25% or more. But, if the Ni content exceeds 4.0%, the creep strength is reduced. For these reasons, the Ni content is determined to be 3.25 to 4.0%. And, the Ni content is more preferably 3.5 to 4.0%.

(8) P (Phosphorus), S (Sulfur), Sn (Tin), As (Arsenic), Sb (Antimony)

These elements are unavoidable impurities that are unavoidably mingled from steelmaking raw material to segregate in grain boundary in extremely small amounts, contributing to the reduction of the ductility and the embrittlement due to aging. Therefore, it is desirable to reduce the contents of the unavoidable impurities as low as industrially possible toward 0%.

For these reasons, the P content was determined to be 0.004% or less and more preferably 0.003% or less. The S content was determined to be 0.002% or less, and more preferably 0.0015% or less. The Sn content was determined to be 0.01% or less, and more preferably 0.005% or less. The As content was determined to be 0.008% or less, and more preferably 0.006% or less. The Sb content was determined to be 0.005% or less, and more preferably 0.0015% or less.

(9) Al (Aluminum)

Al is an unavoidable impurity which is unavoidably mingled from steelmaking raw material similar to the elements described in (8) above. Al might have an effect as the deoxidizing agent, but the inclusion of Al in the heat-resisting steel according to the present invention causes the reduction of the ductility. Therefore, it is desirable to reduce the Al content as low as industrially possible toward 0%. For these reasons, the Al content is determined to be 0.008% or less. And, the Al content is more preferably 0.005% or less.

(10) Cu (Copper)

Cu is an unavoidable impurity which is unavoidably mingled from steelmaking raw material similar to the elements described in (8) and (9) above. Cu has an effect to enhance corrosion resistance depending on its added amount. But, the heat-resisting steel according to the present invention suffers from the reduction of the ductility and the embrittlement due to aging because of the inclusion of Cu. Therefore, it is desirable to reduce the Cu content as low as industrially possible toward 0%. For these reasons, the Cu content is determined to be 0.1% or less. The Cu content is more preferably 0.05% or less.

(11) H (Hydrogen), O (Oxygen), N (Nitrogen)

These elements are unavoidable gases which are unavoidably mingled into steel making to cause embrittlement and become component elements of non-metallic chemical compounds. Therefore, it is desirable to reduce the unavoidable gas contents as low as industrially possible toward 0%.

For these reasons, the H content was determined to be 1.5 ppm or less, and more preferably 1.0 ppm or less. The O content was determined to be 35 ppm or less, and more preferably 30 ppm or less. The N content was determined to be 80 ppm or less, and more preferably 60 ppm or less. Here, the content (ppm) indicates weight ppm.

The unavoidable impurities may contain elements, for example, Mg (magnesium), Ti (titanium) and the like other than the above-described elements, if they do not have an adverse effect on the mechanical strength of the heat-resisting steel, but their contents are desirably reduced as low as possible toward 0%.

As described above, the heat-resisting steel according to the present invention has the unavoidable impurities and unavoidable gases limited to a very small amount. Therefore, when this heat-resisting steel is used to configure a low-pressure turbine rotor, a change in metal structure that induces the embrittlement due to aging, such as grain boundary segregation of the elements because of heating during the low-pressure turbine operation can be suppressed. Therefore, even if the inlet steam temperature of the low-pressure turbine is, for example, 410° C. or more, a stable operation can be performed for a long period. If the inlet steam temperature of the low-pressure turbine exceeds 430° C., a creep deformation due to aging progresses. Therefore, the inlet steam temperature of the low-pressure turbine is limited up to 430° C.

Then, a steam turbine power generation system 10 of a first embodiment of the present invention will be described with reference to FIG. 1.

FIG. 1 shows an overview of the structure of the steam turbine power generation system 10. The steam turbine power generation system 10 is mainly comprised of a high-pressure turbine 11, an intermediate-pressure turbine 12, a low-pressure turbine 13, a generator 14, a condenser 15 and a boiler 16. As a material for the low-pressure turbine rotor of the low-pressure turbine 13 in the steam turbine power generation system 10, the heat-resisting steel according to the present invention which was found to have good mechanical strength for a long period in a high-temperature environment in Example 1 described later is used.

First, the general operation of the steam turbine power generation system 10 is described.

Steam, which is superheated in the boiler 16 and flows out of it, enters the high-pressure turbine 11 through a main steam pipe 17. When it is assumed that moving blades of the high-pressure turbine 11 are configured in, for example, six stages, the steam performs expansion work in the high-pressure turbine 11, is exhausted from a sixth stage outlet, and enters the boiler 16 through a low-temperature reheating pipe 18. The steam having entered the boiler 16 is reheated, and the reheated steam enters the intermediate-pressure turbine 12 through a high-temperature reheating pipe 19.

Where the moving blades of the intermediate-pressure turbine 12 are configured in, for example, six stages, steam having entered and performed expansion work in the intermediate-pressure turbine 12 is discharged through the sixth stage outlet and supplied to the low-pressure turbine 13 through a crossover pipe 20.

The steam supplied to the low-pressure turbine 13 performs expansion work and is condensed into water by the condenser 15. The condensate has its pressure increased by a boiler feed pump 21 and is circulated to the boiler 16. The condensate circulated to the boiler 16 becomes steam, which is then supplied to the high-pressure turbine 11 through the main steam pipe 17. The generator 14 is driven to rotate by the expansion work of the individual steam turbines to generate electric power.

Then, the low-pressure turbine 13 will be described with reference to FIG. 2.

Figure 2:
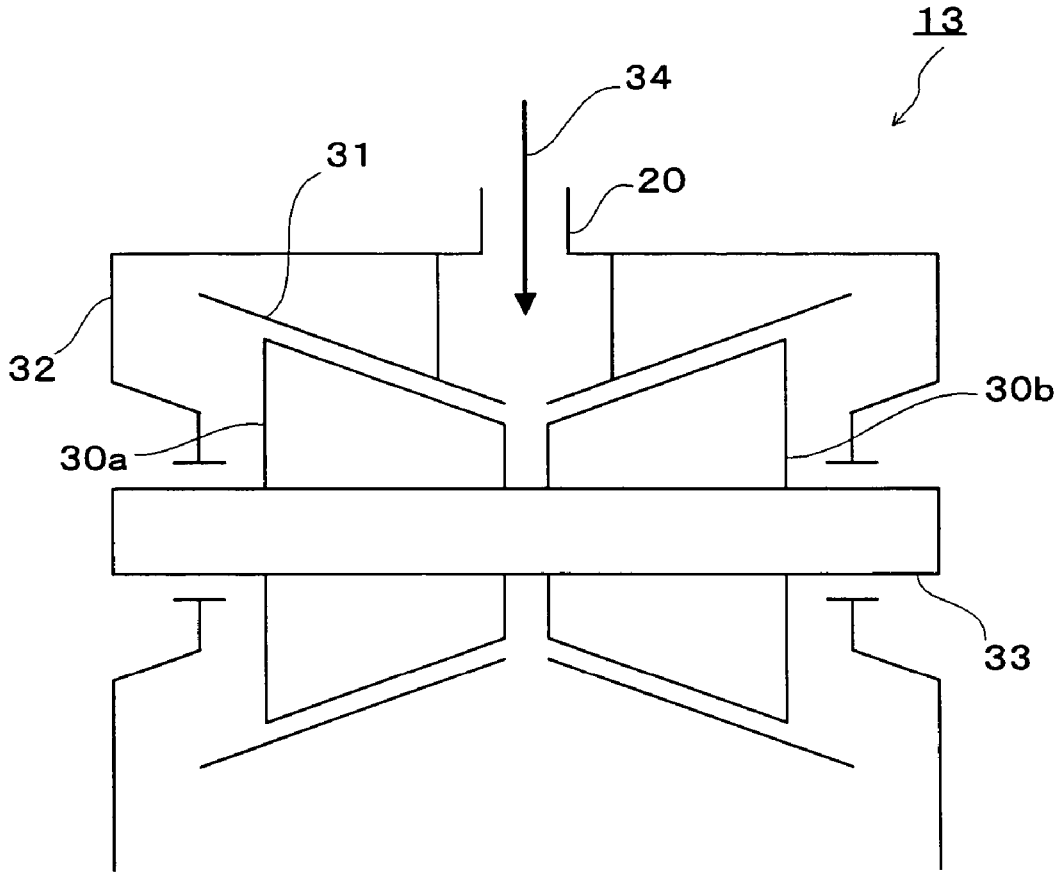
FIG. 2 is a diagram schematically showing a structure of a low-pressure turbine of the steam turbine power generation system according to the first embodiment of the present invention.

FIG. 2 schematically shows an example structure of the low-pressure turbine 13. The low-pressure turbine 13 has two low-pressure turbine sections 30*a* and 30*b* having the same structure tandem-connected. Each of the low-pressure turbine sections 30*a*, 30*b* has moving blades in, for example, six stages, and the low-pressure turbine section 30*a* and the low-pressure turbine section 30*b* are substantially symmetrically configured. A low-pressure turbine inner casing 31 and a low-pressure turbine outer casing 32 are disposed around the low-pressure turbine sections 30*a*, 30*b* to cover them by a double casing structure. A low-pressure turbine rotor 33 is disposed at the axis portion of the low-pressure turbine 13 and coupled with the intermediate-pressure turbine 12 and the generator 14.

As described above, the heat-resisting steel according to the present invention which was found to have good mechanical strength for a long period in a high-temperature environment in Example 1 described later is used for the low-pressure turbine rotor 33, so that a low-pressure turbine inflow steam 34 can be set to a temperature of 410 to 430° C.

For example, in a conventional steam turbine power generation system, when it is determined that an inlet steam temperature of the high-pressure turbine is 630° C., an inlet steam temperature of the intermediate-pressure turbine is 700° C., and an outlet steam temperature of the intermediate-pressure turbine and inlet steam temperature of the low-pressure turbine are about 360° C. similar to that of the conventional steam turbine power generation system, it is necessary that the high-pressure turbine has about nine stages, and the intermediate-pressure turbine has about eight stages. Therefore, the high-pressure turbine and the intermediate-pressure turbine have their sizes in the axial direction increased, and especially, there is apprehension that a steam turbine having the high-pressure turbine and the intermediate-pressure turbine integrally has an increase in vibration of the shaft.

In the present invention, however, the temperature of the low-pressure turbine inflow steam 34 can be set to 410 to 430° C. For example, where the outlet steam temperature of the intermediate-pressure turbine and the inlet steam temperature of the low-pressure turbine are set to about 425° C., the high-pressure turbine and the intermediate-pressure turbine are set to have about six stages.

Accordingly, if the high-pressure turbine and the intermediate-pressure turbine have a high inlet steam temperature, the number of stages of the high-pressure turbine and the intermediate-pressure turbine of the steam turbine power generation system 10 of the present invention can be made smaller than that of the high-pressure turbine and the intermediate-pressure turbine of the conventional steam turbine power generation system. Thus, the high-pressure turbine and the intermediate-pressure turbine can be prevented from increasing their sizes in the axial direction, and a bearing span of the high-pressure turbine and the intermediate-pressure turbine can be set to about 5300 mm similar to the conventional one. And, because the bearing span of the high-pressure turbine and the intermediate-pressure turbine can be set to the similar level of that of the prior art, the vibration of the shaft is also similar to that of the prior art and does not become larger than the conventional one.

Then, specific examples of the present invention will be described below.

EXAMPLE 1

It is described in Example 1 that the low-pressure turbine rotor material of the steam turbine power generation system of the present invention has good mechanical strength for a long period in a high-temperature environment.

Table 1 shows steels which are used as materials for the low-pressure turbine rotor and chemical compositions of the steels which are used in Example 1. Among the steels shown in Table 1, steel type P1 and steel type P2 are heat-resisting steels having chemical compositions that fall in the ranges specified by the present invention, and steel type C1 and steel type C2 are comparative examples having chemical compositions that do not fall in the ranges specified by the present invention.

Individual steels having undergone a tempering heat treatment were subjected to an aging heat treatment at 400 or 450° C. for 50000 hours, then undergone a Charpy impact test by using 2 mm V-notch Charpy impact test pieces according to JIS Z 2202, and measured for ductile-brittle transition temperatures after long-time heating at high temperature. Table 2 shows differences (ΔFATT) between the ductile-brittle transition temperature after the long-time heating at high temperature and the ductile-brittle transition temperature in the initial condition and also shows creep rupture times of the individual steels determined by a creep rupture test conducted at 500° C.-200 MPa.

TABLE 1

| Steel type | | C | Si | Mn | P | S | Ni | Cr | Mo | V | Al | Cu | Sn | As | Sb |
|---|---|---|---|---|---|---|---|---|---|---|---|---|---|---|---|
| E | P1 | 0.28 | 0.021 | 0.05 | 0.004 | 0.002 | 3.36 | 1.57 | 0.39 | 0.09 | 0.006 | 0.07 | 0.008 | 0.007 | 0.0034 |
| | P2 | 0.25 | 0.025 | 0.02 | 0.002 | 0.001 | 3.61 | 1.76 | 0.43 | 0.13 | 0.001 | 0.03 | 0.005 | 0.005 | 0.0013 |
| CE | C1 | 0.29 | 0.060 | 0.32 | 0.011 | 0.009 | 3.56 | 1.89 | 0.46 | 0.14 | 0.008 | 0.12 | 0.014 | 0.013 | 0.0031 |
| | C2 | 0.33 | 0.041 | 0.25 | 0.008 | 0.007 | 3.29 | 1.74 | 0.41 | 0.12 | 0.008 | 0.09 | 0.016 | 0.012 | 0.0028 |

E = Example;
CE = Comparative Example

TABLE 2

| Steel type | | ΔFATT, ° C. 400° C. - 50,000 hours | ΔFATT, ° C. 450° C. - 50,000 hours | Creep repture time (Hour) 500° C. - 200 MPa |
|---|---|---|---|---|
| Example | P1 | 10 | 20 | 37920 |
| | P2 | 5 | 15 | 55281 |
| Comparative | C1 | 220 | 230 | 17248 |
| Example | C2 | 135 | 195 | 9605 |

As shown in Table 2, the ductile-brittle transition temperatures of the steel type P1 and the steel type P2 having the chemical compositions that fall in the ranges specified by the present invention remained within a range of increase up to 20° C. in comparison with the values prior to the heating, but it was found that the ductile-brittle transition temperatures of the steel type C1 and the steel type C2 of the Comparative Example increased greatly up to 230° C. in comparison with the values prior to the heating.

It is also apparent from Table 2 that the creep rupture times of the steel type P1 and the steel type P2 having the chemical compositions that fall in the ranges specified by the present invention are about 2–6 times greater than the creep rupture times of the steel type C1 and the steel type C2 of the Comparative Example.

It is seen from the above results that the low-pressure turbine rotor material having the chemical compositions that fall in the ranges specified by the present invention has its embrittlement after the long-time heating at high temperature suppressed considerably in comparison with a material having the chemical compositions that do not fall in the above ranges and the high temperature creep strength is also increased.

Thus, it was clarified that the low-pressure turbine having the low-pressure turbine rotor which was configured of the heat-resisting steel having the chemical compositions that fall in the ranges specified by the present invention provided excellent operability better than the prior art even if the inlet steam temperature of the low-pressure turbine was raised to 410° C. or more. Besides, it was found that amply excellent operability was shown when the inlet steam temperature of the low-pressure turbine of the present invention was in a range of 410 to 430° C.

(Second Embodiment)

Then, a steam turbine power generation system according to the second embodiment of the present invention will be described with reference to FIG. 3.

The steam turbine power generation system of the second embodiment has the same construction and the same turbine rotor material for the low-pressure turbine of the steam turbine power generation system of the first embodiment except that the steam inlet portion of the low-pressure turbine 13 of the steam turbine power generation system of the first embodiment is changed to a different structure. Accordingly, a structure of the steam inlet portion of a low-pressure turbine 50 of the steam turbine power generation system of the second embodiment will be described below.

Figure 3:
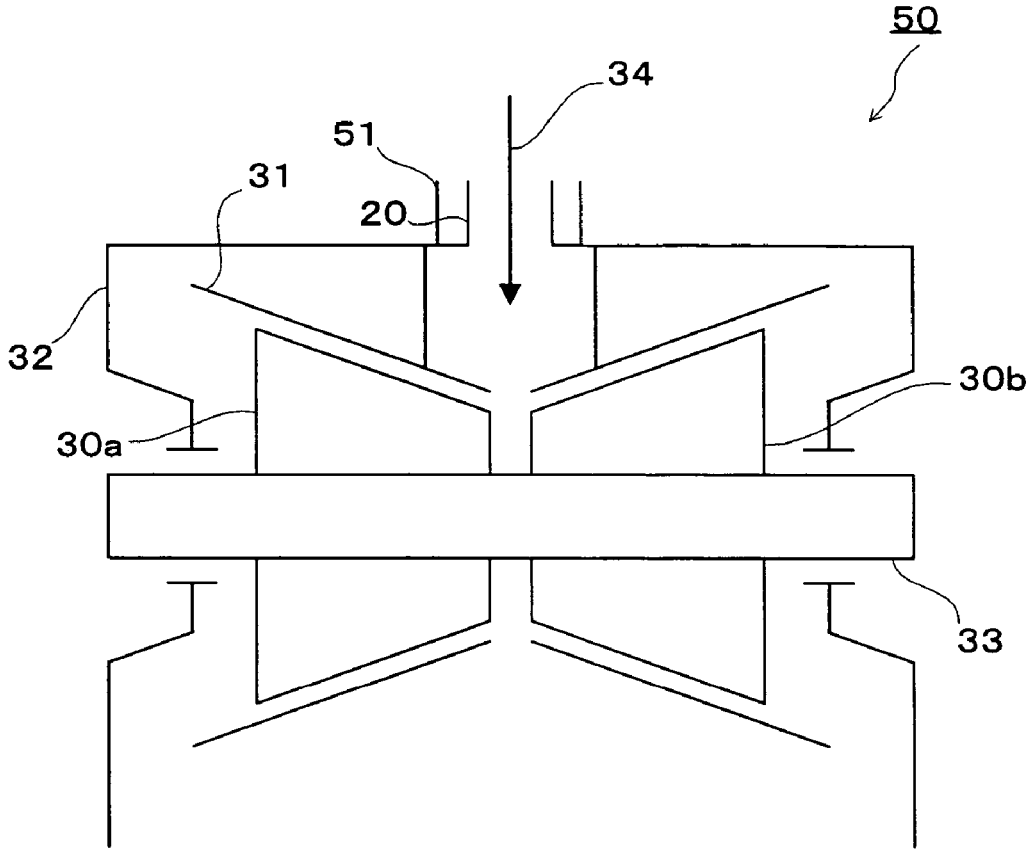
FIG. 3 is a diagram schematically showing a structure of a low-pressure turbine of the steam turbine power generation system according to a second embodiment of the present invention.

FIG. 3 shows schematically a structure of the low-pressure turbine 50. It is to be understood that like component parts as those of the low-pressure turbine 13 of the steam turbine power generation system of the first embodiment are denoted by like reference numerals.

The low-pressure turbine 50 has two low-pressure turbine sections 30*a* and 30*b* having the same structure tandem-connected. Each of the low-pressure turbine sections 30*a*, 30*b* has moving blades in, for example, six stages, and the low-pressure turbine section 30*a* and the low-pressure turbine section 30*b* are substantially symmetrically configured. A low-pressure turbine inner casing 31 and a low-pressure turbine outer casing 32 are disposed around the low-pressure turbine sections 30*a*, 30*b* to cover them by a double casing structure. A low-pressure turbine rotor 33 is disposed at the axis portion of the low-pressure turbine 50 and coupled with the intermediate-pressure turbine 12 and the generator 14.

Then, an example structure of the steam inlet portion of the low-pressure turbine 50 will be described below.

A crossover pipe 20 which guides the steam exhausted from the intermediate-pressure turbine 12 to the low-pressure turbine 50 is connected to the low-pressure turbine outer casing 32 between the low-pressure turbine section 30*a* and the low-pressure turbine section 30*b*. A cooling medium drive pipe 51 which has its one end connected to the low-pressure turbine outer casing 32 is disposed partly around the crossover pipe 20. The crossover pipe 20 and the cooling medium drive pipe 51 configure a double-pipe structure, and the space formed between the crossover pipe 20 and the cooling medium drive pipe 51 configures a passage for a cooling medium which functions as a cooling medium. The cooling medium flows through the space between the crossover pipe 20 and the cooling medium drive pipe 51 to cool the vicinity of the low-pressure turbine outer casing 32 to which the crossover pipe 20 is connected.

A length of the cooling medium drive pipe 51 which is disposed along the crossover pipe 20 and the space between the crossover pipe 20 and the cooling medium drive pipe 51 are determined depending on a kind of cooling medium, a flow rate of the cooling medium, a coefficient of thermal conductivity of the material configuring the crossover pipe 20 and the cooling medium drive pipe 51, and a flow rate and temperature of steam flowing through the crossover pipe 20 such that the temperature of the low-pressure turbine outer casing 32 does not become an upper temperature limit or more even if the steam flowing into the low-pressure turbine 50 is in a range of from 410 to 430° C.

Here, for example, compressed air or the like can be used as the cooling medium. For example, when the compressed air is used as the cooling medium, the compressed air after the cooling is discharged to the atmosphere.

By disposing the cooling structure of the steam inlet portion of the above-described low-pressure turbine 50, a material for the low-pressure turbine outer casing 32 of the steam inlet portion, which is connected to the crossover pipe 20, can be made of the material for the conventional low-pressure turbine outer casing, for example, carbon steel even when steam having a temperature higher than the inlet steam temperature of the conventional low-pressure turbine flows into the low-pressure turbine 50. And, a service life of the low-pressure turbine can be set to the same as the prior art.

It is to be noted that the present invention is not limited to the described embodiments and many other changes and modifications may be made without departing from the scopes of the appended claims. All changed or modified embodiments that come within the meaning and range of equivalency of the claims are intended to be embraced therein.

What is claimed is:

1. A steam turbine power generation system including a high-pressure turbine, an intermediate-pressure turbine and a low-pressure turbine, wherein the intermediate-pressure turbine has an inlet steam temperature of 650 to 720° C., and the low-pressure turbine has an inlet steam temperature of 410 to 430° C.; and wherein a low-pressure turbine rotor of the low-pressure turbine is made of a heat-resisting steel which contains, in weight percent, C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0, and the balance of Fe, unavoidable impurities and unavoidable gases, and the unavoidable impurities contain, in weight percent, P: 0.004 or less, S: 0.002 or less, Sn: 0.01 or less, As: 0.008 or less, Sb: 0.005 or less, Al: 0.008 or less and Cu: 0.1 or less.

2. A steam turbine power generation system including a high-pressure turbine, an intermediate-pressure turbine and a low-pressure turbine, wherein the intermediate-pressure turbine has an inlet steam temperature of 650–720° C., and the low-pressure turbine has an inlet steam temperature of 410–430° C.; and wherein a low-pressure turbine rotor of the low-pressure turbine is made of a heat-resisting steel which contains, in weight percent, C: 0.24 to 0.27, Si: 0.03 or less, Mn: 0.03 or less, Cr: 1.6 to 1.8, V: 0.1 to 0.15, Mo: 0.4 to 0.45, Ni: 3.5 to 4.0, and the balance of Fe, unavoidable impurities and unavoidable gases, and the unavoidable impurities contain, in weight percent, P: 0.003 or less, S: 0.0015 or less, Sn: 0.005 or less, As: 0.006 or less, Sb: 0.0015 or less, Al: 0.005 or less and Cu: 0.05 or less.

3. The steam turbine power generation system according to claim 1 or 2, wherein the high-pressure turbine has an inlet steam temperature of 650–720° C.

4. The steam turbine power generation system according to claim 1 or 2, further comprising:

cooling means for cooling an outer casing of a steam inlet portion of the low-pressure turbine.

5. A low-pressure turbine rotor of a low-pressure turbine in a steam turbine power generation system which is comprised of a high-pressure turbine, an intermediate-pressure turbine and the low-pressure turbine, the intermediate-pressure turbine having an inlet steam temperature of 650–720° C., and the low-pressure turbine having an inlet steam temperature of 410–430° C., wherein the low-pressure turbine rotor is made of a heat-resisting steel which contains, in weight percent, C: 0.28 or less, Si: 0.03 or less, Mn: 0.05 or less, Cr: 1.5 to 2.0, V: 0.07 to 0.15, Mo: 0.25 to 0.5, Ni: 3.25 to 4.0, and the balance of Fe, unavoidable impurities and unavoidable gases; and wherein the unavoidable impurities contain, in weight percent, P: 0.004 or less, S: 0.002 or less, Sn: 0.01 or less, As: 0.008 or less, Sb: 0.005 or less, Al: 0.008 or less and Cu: 0.1 or less.

6. A low pressure turbine rotor of a low-pressure turbine in a steam turbine power generation system which is comprised of a high-pressure turbine, an intermediate-pressure turbine and the low-pressure turbine, the intermediate-pressure turbine having an inlet steam temperature of 650–720° C., and the low-pressure turbine having an inlet steam temperature of 410–430° C., wherein the low-pressure turbine rotor is made of a heat-resisting steel which contains, in weight percent, C: 0.24 to 0.27, Si: 0.03 or less, Mn: 0.03 or less, Cr: 1.6 to 1.8, V: 0.1 to 0.15, Mo: 0.4 to 0.45, Ni: 3.5 to 4.0, and the balance of Fe, unavoidable impurities and unavoidable gases; and wherein the unavoidable impurities contain, in weight percent, P: 0.003 or less, S: 0.0015 or less, Sn: 0.005 or less, As: 0.006 or less, Sb: 0.0015 or less, Al: 0.005 or less and Cu: 0.05 or less.

7. The low-pressure turbine rotor according to claim 5 or 6, wherein the high-pressure turbine has an inlet steam temperature of 650–720° C.

* * * * *